US006511196B1

(12) United States Patent
Hoy

(10) Patent No.: US 6,511,196 B1
(45) Date of Patent: Jan. 28, 2003

(54) CONTAINER WITH ILLUMINATED INTERIOR VISUAL DISPLAY

(76) Inventor: Richard Dale Hoy, 7033 Clubgate Dr., Corpus Christi, TX (US) 78413

( * ) Notice: Subject to any disclaimer, the term of this patent is extended or adjusted under 35 U.S.C. 154(b) by 0 days.

(21) Appl. No.: 09/716,544

(22) Filed: Nov. 20, 2000

(51) Int. Cl.[7] ..... F21V 33/00

(52) U.S. Cl. ..... 362/101; 362/96; 362/800; 362/806; 362/505; 362/562

(58) Field of Search ..... 362/101, 96, 154, 362/800, 806, 318, 364, 551, 565, 562, 326, 308; 206/217

(56) References Cited

U.S. PATENT DOCUMENTS

| | | | | |
|---|---|---|---|---|
| 2,177,337 | A | * 10/1939 | Stein | 240/6.4 |
| 2,224,319 | A | 12/1940 | Schroyer | |
| 2,604,579 | A | 7/1952 | Deneboudes | |
| 2,663,866 | A | 12/1953 | Simpson | |
| 2,745,947 | A | 5/1956 | Sansous | |
| 3,218,447 | A | 11/1965 | Pardue | |
| 3,735,113 | A | 5/1973 | Stott | |
| 3,878,386 | A | 4/1975 | Douglas | |
| 4,034,213 | A | 7/1977 | Norris | |
| D254,946 | S | 5/1980 | Taybei | |
| 4,261,026 | A | 4/1981 | Bolha | |
| 4,344,113 | A | 8/1982 | Ditto et al. | |
| 4,390,928 | A | 6/1983 | Runge | |
| 4,563,726 | A | 1/1986 | Newcomb et al. | |
| 4,594,646 | A | 6/1986 | Von Kohorn et al. | |
| 4,616,304 | A | 10/1986 | Von Kohorn | |
| 4,626,968 | A | 12/1986 | Von Kohorn | |
| 4,630,177 | A | 12/1986 | Von Kohorn et al. | |
| 4,686,611 | A | 8/1987 | Von Kohorn | |
| 4,725,930 | A | 2/1988 | Von Kohorn | |
| 4,729,069 | A | 3/1988 | Von Kohron et al. | |
| 4,758,934 | A | 7/1988 | von Kohorn | |
| D301,103 | S | 5/1989 | Nadershahi | |
| 4,845,602 | A | 7/1989 | Lehocki | |
| 4,858,084 | A | 8/1989 | Sheryll | |
| 4,858,085 | A | 8/1989 | Von Kohorn | |
| 4,922,355 | A | 5/1990 | Dietz et al. | |
| 4,924,361 | A | 5/1990 | Von Kohorn | |
| 4,945,460 | A | 7/1990 | Von Kohorn | |
| 4,980,807 | A | 12/1990 | Von Kohorn | |
| 5,010,461 | A | 4/1991 | Saotome | |
| 5,070,435 | A | 12/1991 | Weller | |
| 5,119,279 | A | 6/1992 | Makowsky | |
| 5,171,081 | A | 12/1992 | Pita et al. | |
| 5,178,450 | A | 1/1993 | Zelemsky et al. | |
| 5,201,577 | A | 4/1993 | Suzuki et al. | |
| 5,211,699 | A | 5/1993 | Tipton | |

(List continued on next page.)

FOREIGN PATENT DOCUMENTS

| | | |
|---|---|---|
| DE | 701 798 | 1/1941 |
| FR | 816795 | 8/1937 |
| FR | 1516076 | 6/1968 |

*Primary Examiner*—Alan Cariaso
*Assistant Examiner*—Sharon Payne
(74) *Attorney, Agent, or Firm*—George S. Gray

(57) ABSTRACT

An illuminated message or design is displayed on the surface of an inner container for viewing through an outer container. Light emitting diodes are placed under the outer container, and near its perimeter, allowing the light to be directly introduced into the peripheral wall cavity formed between the inner container and outer container. This allows optimal utilization of the light for lighting the inner container surface generally, and for directing a portion of the light to the inner container's bottom edge for entrapment within the inner container peripheral wall. The entrapped light is transmitted through the inner container peripheral wall until the light encounters a nonconformity that redirects the light outwardly through the outer container. Varying inner container shapes interact with the light and create several distinct light mantles.

84 Claims, 15 Drawing Sheets

U.S. PATENT DOCUMENTS

D336,594 S 6/1993 Trush
5,226,721 A 7/1993 Stokes
5,277,644 A 1/1994 Osborne et al.
5,307,244 A 4/1994 Gaudette
5,307,250 A 4/1994 Pearson
5,311,413 A 5/1994 Farmer et al.
5,331,527 A 7/1994 Stokes
5,339,548 A 8/1994 Russell
D355,812 S 2/1995 DuBow
5,388,039 A 2/1995 Dolph
5,400,229 A 3/1995 Lin
5,406,466 A 4/1995 Stokes
D358,080 S 5/1995 Handler
D362,921 S 10/1995 Krystek
D363,854 S 11/1995 Katz
5,487,662 A 1/1996 Kipke et al.
D366,813 S 2/1996 Nobles
5,504,663 A 4/1996 Tucker
5,553,735 A 9/1996 Kimura
5,567,045 A 10/1996 Bucek
5,575,553 A 11/1996 Tipton
5,594,433 A 1/1997 Terlep
5,609,409 A 3/1997 Diehl
5,624,177 A 4/1997 Rosaia
D380,122 S 6/1997 Wong
5,654,552 A 8/1997 Toombs
5,673,789 A 10/1997 Degraff-Eugene
5,685,630 A 11/1997 Herman
5,687,497 A 11/1997 Moore
5,695,270 A 12/1997 Collet
5,711,099 A 1/1998 Nesbit et al.
5,722,767 A 3/1998 Lin
5,739,903 A 4/1998 Kepner
5,743,620 A 4/1998 Rojas et al.
5,752,766 A 5/1998 Bailey et al.
5,772,065 A 6/1998 Kalamaras
5,779,146 A 7/1998 Cutler
5,784,265 A 7/1998 Chen
5,785,406 A 7/1998 Lee
5,785,407 A 7/1998 Ratcliff et al.
5,803,306 A 9/1998 Lewis
5,806,263 A 9/1998 Coleman
5,816,883 A 10/1998 Holland
5,822,898 A 10/1998 Weissleder
D400,406 S 11/1998 House
5,833,349 A 11/1998 Apple
5,839,599 A 11/1998 Lin
5,869,154 A 2/1999 Benson
5,879,068 A 3/1999 Menashrov et al.
5,879,071 A 3/1999 Sanford, Jr.
5,902,166 A 5/1999 Robb
5,915,832 A 6/1999 Baird, Sr.
5,921,663 A 7/1999 Vukosic
5,931,383 A 8/1999 Palmer et al.
5,934,558 A 8/1999 Chen
5,951,154 A 9/1999 Carel et al.
5,990,790 A 11/1999 Lusareta
6,005,204 A 12/1999 Choi et al.
6,010,235 A 1/2000 Sawyer
6,024,624 A 2/2000 Lee
6,033,087 A 3/2000 Shozo et al.
6,033,089 A 3/2000 Tesauro
6,036,570 A 3/2000 Nadel
6,043,732 A 3/2000 Shulman
6,050,414 A 4/2000 Saffron et al.
6,054,156 A 4/2000 Rudell et al.
6,062,380 A 5/2000 Dorney
6,065,848 A 5/2000 Tucker et al.
6,072,161 A 6/2000 Stein
6,076,937 A 6/2000 Wood et al.
6,076,940 A 6/2000 Sanford, Jr.
6,082,866 A 7/2000 Amedee
6,082,877 A 7/2000 Hughes
6,084,526 A 7/2000 Blotky et al.
6,128,854 A 10/2000 Chaney
6,213,616 B1 * 4/2001 Chien ..... 362/84

* cited by examiner

CONTAINER WITH ILLUMINATED INTERIOR VISUAL DISPLAY

BACKGROUND OF THE INVENTION

1. Field of the Invention

The present invention relates generally to illuminated container displays. Such displays are highly desirable for advertising messages and other marketing efforts, and are particularly effective when illuminated and presented on such devices as mugs and tumblers.

2. Description of the Prior Art

Containers, including mugs and tumblers for beverages, are available in the industry and some include illumination and illuminated messages, designs, symbols, trademarks, patterns and the like.

Among those containers is the wine glass disclosed in U.S. Pat. No. 3,735,113, issued to Thomas H. Stott for a fiber optical display in the wine glass. Light from a light source in the stem is confined within optical fibers and routed into a transparent double wall. The fibers create an optical display within the double wall at the ends of the fibers where the light is released.

Another container is the drinking glass disclosed in U.S. Pat. No. 2,663,866, issued to R. E. Simpson. An image with text is on the bottom of the liquid containing portion of the glass, and is illuminated by light sources in a base.

An illuminated container that has an illuminated emblem on the exterior surface of a drinking container, is disclosed in U.S. Pat. No. 5,785,407, issued to William R. Ratcliffe, et al. A light source is adjacent the emblem.

Mugs are described in U.S. Pat. Nos. 5,575,553 and 5,211,699, issued to Tommy B. Tipton, which have light emitting diodes positioned within the outer wall of the drinking container, from which light is sent through the outer wall of the mug to recessed indicia on the outer surface of the containers. The light escapes from within the outer wall through the recessed indicia. In a third illuminated mug, Tipton has a separate base which positions the light emitting diodes for encapsulation by the container outer wall when attached.

A drinking glass holder having a centrally positioned light source is disclosed in U.S. Pat. No. 2,745,947, issued to J. L. Sansous. The light source is positioned adjacent the apex of a transparent dome which along with the sides of the holder support a drinking glass.

An ice bucket has a message visible through the outer wall of the bucket in U.S. Pat. No. 2,604,579, issued to C. Deneboudes. A light source is positioned within the outer container directly behind the message. Other light sources within the outer container are visible from within the inner container through portals in the inner container near the top.

A drinking glass is disclosed in U.S. Pat. No. 5,070,435 issued to Harvey G. Weller, that includes a light emitting diode placed adjacent a design cut into the outer surface of the glass. Fiber optics are included in the design on the outer surface.

The illuminated beverage vessel disclosed in U.S. Pat. No. 4,922,355, issued to M. David Dietz, et al., includes a light source directing light into the bottom center of the drinking vessel.

Although the above containers are useful, no prior art containers are known that use an inner container as the target area for illuminated messages and designs. To attractively and cleanly illuminate a message or design on the inner container's outer surface requires that the space between such surface and the outer container be free from obstructions such as a source of light that would block the view of the message or design.

To provide the optimum view of such a message or design also requires that the message or design be viewable through the outer container.

Such a goal also requires that the source of light be positioned near the perimeter of the outer container in order to direct the light into the space and onto the inner container outer surface. Similarly, such positioning must be accomplished in a manner that avoids any significant entrapment of the light in the outer container wall. Such entrapment would dilute the illumination of the inner container message or design and possibly create visual interference. To avoid such entrapment the source of light must be vertically unaligned with the outer container wall.

What is needed is a carefully configured container having a transparent outer container that allows an unobstructed view of an illuminated message or design on the outer surface of an inner container, the illumination source being positioned out of the peripheral wall cavity between the outer and inner containers, yet near the perimeter of the outer container, in order to directly light such space and the target message or design. Such illumination should occur without significant loss of light on the bottom of the inner container or by entrapment within the outer container wall.

SUMMARY OF THE PRESENT INVENTION

My invention is a container that provides aesthetically pleasing, unobstructed and effective illumination of a message or design on the outer surface of an inner container, the message or design being easily viewable through an outer container that supports the inner container.

A peripheral wall space, or cavity, is formed between the outer surface of the inner container and the outer container peripheral wall, the outer container being supported by a detachable base. A light source, in the form of at least one light emitting diode, is carefully positioned in the base near the perimeter of the attached outer container in order to introduce light directly from beneath the outer container, into the peripheral wall cavity and onto the inner container's outer surface. Positioning the light source near the perimeter of the outer container avoids undue illumination of the largely unviewable bottom of the inner container, which, in the case of a drinking vessel, should extend to, or near, the outer container bottom.

Placing the light source beneath the outer container and out of the peripheral space allows the peripheral space to be free of light source related hardware, such as wiring and diodes, that would otherwise obstruct the view of the illuminated message or design on the inner container.

Such positioning is also optimal for enabling a broad and sweeping light mantle to bathe the inner container outer surface, thus creating a simulated neon sign effect.

At the same time such positioning can allow some light to encounter the bottom edge of the inner container. This encounter allows some of the light to be transmitted through the inner container's peripheral wall to the surface nonconformities intentionally included in the message or design, such as protruding or recessed figures, alphanumeric characters, designs, symbols, and the like, that are multifaceted. As the light in the inner container wall encounters such nonconformities many such facets are more intensely illuminated than the surrounding features.

The light source is also positioned out of vertical alignment with the outer container wall to avoid entrapment of any significant amount of light in the outer container wall.

Further directional control of the light exiting the light source is provided by the inclusion of a light altering element proximate the outer container bottom, or integral therewith. This light altering element enhances the inner container illumination effectiveness and assists in avoiding outer container wall light entrapment.

My invention includes inner containers of various shapes. In addition to being visually appealing in their own right, the various shapes interact with the light from the light emitting diode and alter the light, creating a wide variety of aesthetically pleasing light mantle shapes.

Using the inner container's outer surface as the message or design display area provides advantages over placing the message or design displays on the outer container. For example, a predominant marketing tool is a mug printed with a company's trademark, logo, or advertising message. In the typical screen printing process, the mug's handle prevents a full surround screen print. Full surround screen printing is available for the inner container since no handle is present.

In addition, an exteriorly presented message or design cannot practically be bathed in light from a self-contained light source, but is instead limited to backlighting or container wall entrapment and release. The inner container message is ideally positioned to be bathed in light from a self-contained light source.

Furthermore, presenting the message or design on the inner container allows the same base and outer container to be usable with a wide variety of interchangeable inner containers.

The inner container has an upper rim that is positioned on the outer container in such a manner that light from the peripheral wall cavity encounters the underside of the upper rim. This causes a striking glow effect on the inner container upper rim.

My invention provides an illuminated container, comprising: an outer container having a peripheral wall and a bottom, the outer container peripheral wall and bottom being at least partially light-pervious; an inner container having an outer surface, the inner container positioned at least partially within the outer container to form a peripheral wall cavity between at least a portion of the inner container outer surface and the outer container peripheral wall; and at least one light source positioned beneath the outer container bottom in a substantially vertical alignment with the peripheral wall cavity, such that the light source directs light through the outer container bottom, into the peripheral wall cavity and onto the inner container outer surface, the illuminated portion of the inner container outer surface being at least partially visible through the outer container peripheral wall.

In another embodiment the foregoing container further comprises a light altering element positioned with respect to the at least one light source such that at least part of the light is directionally altered prior to striking the inner container outer surface.

In another embodiment, the light altering element is positioned above the outer container bottom.

In another embodiment, the light altering element is positioned below the outer container bottom.

In another embodiment, the light altering element is attached to the outer container and is positioned above the outer container bottom.

In another embodiment, wherein the light altering element is attached to the outer container and is positioned below the outer container bottom.

In another embodiment, the outer container bottom further comprises a light altering element such that at least part of the light is directionally altered prior to striking the inner container outer surface.

In another embodiment, the outer container peripheral wall has a curved inside surface and the light altering element is generally planar and curved, the light altering element curve following the outer container peripheral wall curved inner surface.

In another embodiment, the at least one light source has a light emitting portion and the light altering element has an inside edge, the inside edge being positioned such that an imaginary line extending perpendicularly from the inside edge intersects the at least one light source light emitting portion.

In another embodiment, the inner container further comprises a peripheral wall and at least one light altering nonconformity on the peripheral wall.

In another embodiment, the light altering nonconformity alters the direction of light striking the light altering nonconformity from the peripheral wall cavity.

In another embodiment, a portion of the light striking the inner container outer surface enters and is transported by the inner container peripheral wall to the light altering nonconformity, and the light altering nonconformity alters the direction of such light.

In another embodiment, the light altering nonconformity protrudes from the inner container outer surface.

In another embodiment, the light altering nonconformity is recessed in the inner container peripheral wall.

In another embodiment, the light altering nonconformity includes alphanumeric characters and figures.

In another embodiment, the light altering nonconformity includes designs.

In another embodiment, the light altering nonconformity is illuminated by the altered light such that the nonconformity is visible through the outer container peripheral wall.

In another embodiment, the light altering nonconformity causes a portion of the light to be directed toward the outer container peripheral wall.

In another embodiment, the light altering nonconformity further comprises at least one aspect, the light altering nonconformity causing a portion of the light to intensify the illumination of the at least one aspect.

In another embodiment, the light altering nonconformity causes a portion of the light to be diffused.

In another embodiment, the inner container further comprises a peripheral wall and a bottom, the positioned inner container forming a bottom peripheral cavity between the inner container bottom and the outer container bottom.

In another embodiment, the inner container further comprises at least one light altering nonconformity on the inner container peripheral wall.

In another embodiment, a portion of the light striking the inner container outer surface enters the inner container bottom and is transported through the inner container peripheral wall to the light altering nonconformity, and the light altering nonconformity alters the direction of such light.

In another embodiment, the inner container has a generally planar bottom and a peripheral wall, the peripheral wall being circularly shaped and tapered along its length to the bottom.

In another embodiment, the joinder of the inner container peripheral wall to the inner container bottom is angular.

In another embodiment, the joinder of the inner container peripheral wall to the inner container bottom is curved.

In another embodiment, the inner container has a generally planar bottom and a peripheral wall, the peripheral wall being circularly shaped and tapered along a first portion of its length at one angle, and along a second portion of its length at a second, more severe angle, to the bottom.

In another embodiment, the joinder of the inner container peripheral wall to the inner container bottom is angular.

In another embodiment, the joinder of the inner container peripheral wall to the inner container bottom is curved.

In another embodiment, the change in taper is angular.

In another embodiment, the change in taper is curved.

In another embodiment, the inner container has a generally planar bottom and a peripheral wall, the peripheral wall being circularly shaped and tapered along a first portion of its length, and curved along a second portion of its length to the bottom.

In another embodiment, the joinder of the inner container peripheral wall to the inner container bottom is angular.

In another embodiment, the joinder of the inner container peripheral wall to the inner container bottom is curved.

In another embodiment, the inner container has a bottom and a peripheral wall, the peripheral wall being circularly shaped and tapered along a first portion of its length, and curved along a second portion of its length to the bottom.

In another embodiment, the inner container has a generally planar bottom and a peripheral wall, the peripheral wall being circularly shaped and tapered along a first portion of its length, and radially stepped along a second portion of its length to the bottom.

In another embodiment, the inner container has a generally planar bottom and a peripheral wall, the peripheral wall being square shaped and tapered along its length to the bottom.

In another embodiment, the square shape includes rounded corner shapes.

In another embodiment, the inner container has a generally planar bottom and a peripheral wall, the peripheral wall being triangle shaped and tapered along its length to the bottom.

In another embodiment, the triangle shape includes rounded corner shapes.

In another embodiment, the outer container has a top edge and the inner container has a top edge, the top edge extending over the outer container top edge, the top edge being at least partially illuminated by the light in the peripheral wall cavity, such illumination causing the top edge to glow.

In another embodiment, the outer container has a top edge and the inner container has a top edge, the outer container top edge supporting and securing the inner container top edge.

In another embodiment, the at least one light source is a light emitting diode.

In another embodiment, the at least one light emitting diode is clear.

In another embodiment, the at least one light emitting diode is diffused.

In another embodiment, the at least one light emitting diode is dome shaped.

In another embodiment, the at least one light emitting diode is cylindrical.

In another embodiment, the at least one light emitting diode is rectangular.

In another embodiment, the at least one light emitting diode is flat-topped.

In another embodiment, the at least one light emitting diode emits white light.

In another embodiment, the at least one light emitting diode emits colored light.

In another embodiment, the outer container further comprises a base, the at least one light source being positioned in the base.

In another embodiment, the base is detachable from the outer container.

In another embodiment, the base is configured to receive a battery for powering the at least one light source.

In another embodiment, the base further comprises means for receiving and securing a battery for powering the at least one light source.

In another embodiment, the number of light sources is two.

In another embodiment, the light sources are positioned opposite from each other with respect to the outer container peripheral wall.

In another embodiment, the number of light sources is three.

In another embodiment, the light sources are positioned equidistantly.

In another embodiment, the number of light sources is four.

In another embodiment, the light sources are positioned equidistantly.

In another embodiment, the number of light sources is five or more.

In another embodiment, the light sources are positioned equidistantly.

In another embodiment, 64. The container of claim 1, wherein the at least one light source is battery powered.

In another embodiment, 65. The container of claim 1, further comprising means for powering the at least one light source by battery power.

My invention provides an illuminated container, comprising: an outer container having a peripheral wall and a bottom, the outer container peripheral wall and bottom being at least partially light-pervious; an inner container having an outer surface, the inner container positioned at least partially within the outer container to form a peripheral wall cavity between at least a portion of the inner container outer surface and the outer container peripheral wall; and means for directing light through the outer container bottom, into the peripheral wall cavity and onto the inner container outer surface, the illuminated portion of the inner container outer surface being at least partially visible through the outer container peripheral wall.

In another embodiment, the foregoing container further comprises means for directionally altering the light prior to the light striking the inner container outer surface.

In another embodiment, the outer container bottom further comprises means for directionally altering the light prior to the light striking the inner container outer surface.

In another embodiment, the inner container further comprises a peripheral wall and means for altering the light, the means being positioned on the inner container peripheral wall.

In another embodiment, the means for altering the light alters the direction of light striking the light from the peripheral wall cavity.

In another embodiment, a portion of the light striking the inner container outer surface enters and is transported by the inner container peripheral wall to the means for altering the light, and the means for altering the light alters the direction of such light.

In another embodiment, the light altering nonconformity protrudes from the inner container outer surface.

In another embodiment, the means for altering the light is recessed in the inner container peripheral wall.

In another embodiment, the means for altering the light includes alphanumeric characters and figures.

In another embodiment, the means for altering the light includes designs.

In another embodiment, the means for altering the light is illuminated by the altered light such that the nonconformity is visible through the outer container peripheral wall.

In another embodiment, the means for altering the light causes a portion of the light to be directed toward the outer container peripheral wall.

In another embodiment, the means for altering the light further comprises at least one aspect, the means for altering the light causing a portion of the light to intensify the illumination of the at least one aspect.

In another embodiment, the means for altering the light causes a portion of the light to be diffused.

In another embodiment, the inner container further comprises a peripheral wall and a bottom, the positioned inner container forming a bottom peripheral cavity between the inner container bottom and the outer container bottom, the inner container further comprising means for altering the light the means being on the inner container peripheral wall.

In another embodiment, a portion of the light striking the inner container outer surface enters the inner container bottom and is transported through the inner container peripheral wall to the means for altering the light, the means for altering the light altering the direction of such light.

In another embodiment, the inner container has a top edge and means for illuminating the inner container top edge by light from the peripheral wall cavity, such illumination causing the top edge to glow.

My invention provides an illuminated container, comprising: an outer container having a peripheral wall and a bottom, the outer container peripheral wall and bottom being at least partially light-pervious; an inner container having a peripheral wall, the inner container positioned at least partially within the outer container to form a peripheral wall cavity between at least a portion of the inner container peripheral wall and the outer container peripheral wall; and means for directing light through the outer container bottom, into the peripheral wall cavity and onto a targeted portion of the inner container peripheral wall, the illuminated target portion of the inner container peripheral wall being at least partially visible through the outer container peripheral wall.

The foregoing features and other advantages will appear from the description to follow. In the description, reference is made to the accompanying drawings, which form a part hereof, and in which is shown by way of illustration, specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DETAILED DESCRIPTION OF THE PREFERRED EMBODIMENTS

Figure 1:
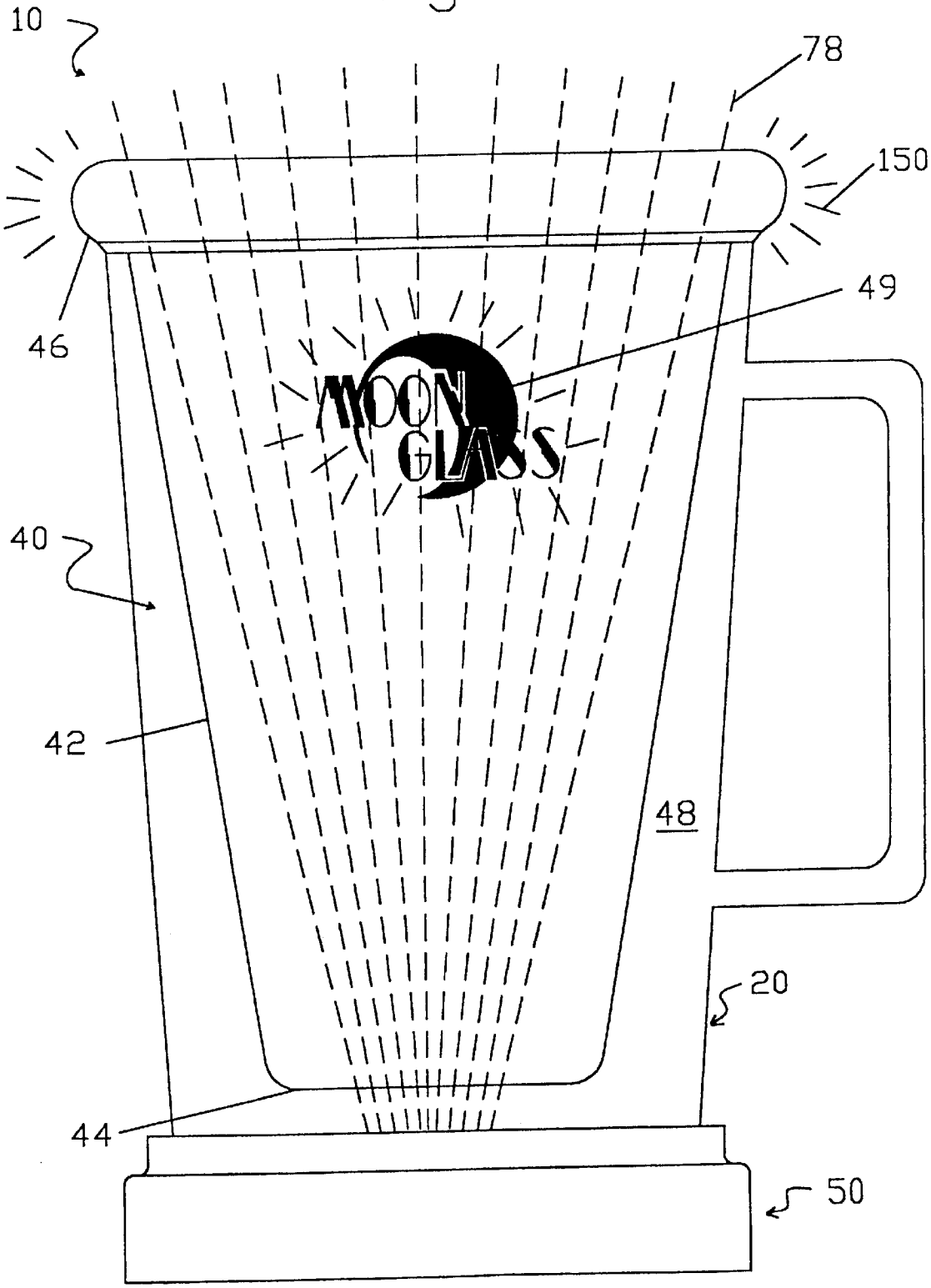
FIG. 1 is a side view of an embodiment of the present invention.

Turning now descriptively to the drawings, in which similar reference characters denote similar elements throughout the several views, FIGS. 1–15 illustrate the present invention indicated generally by the numeral 10.

Figure 2:
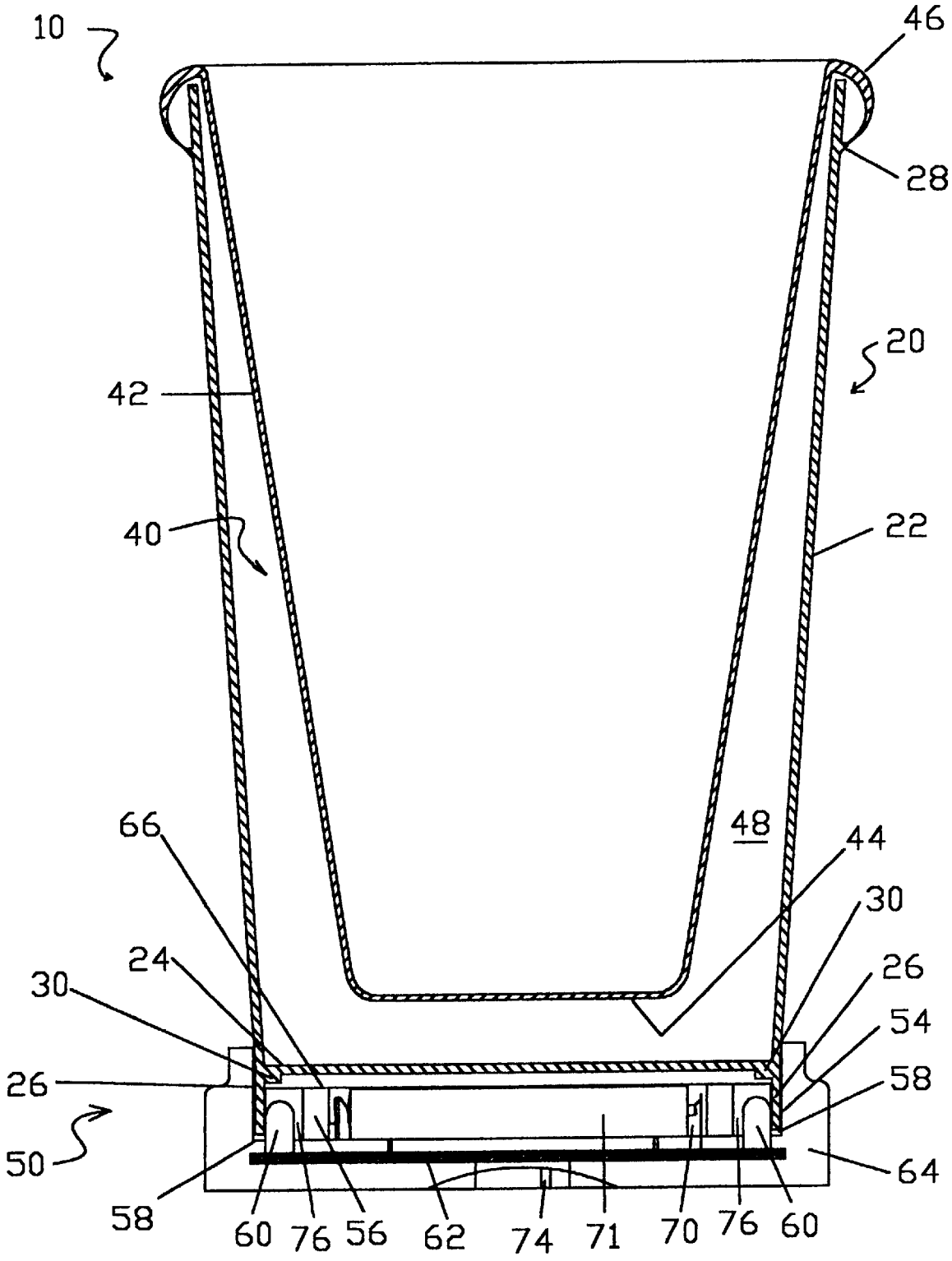
FIG. 2 is a cross-sectional side view of the present invention cut along cutting plane 2—2, as shown on FIG. 1.
Figure 3:
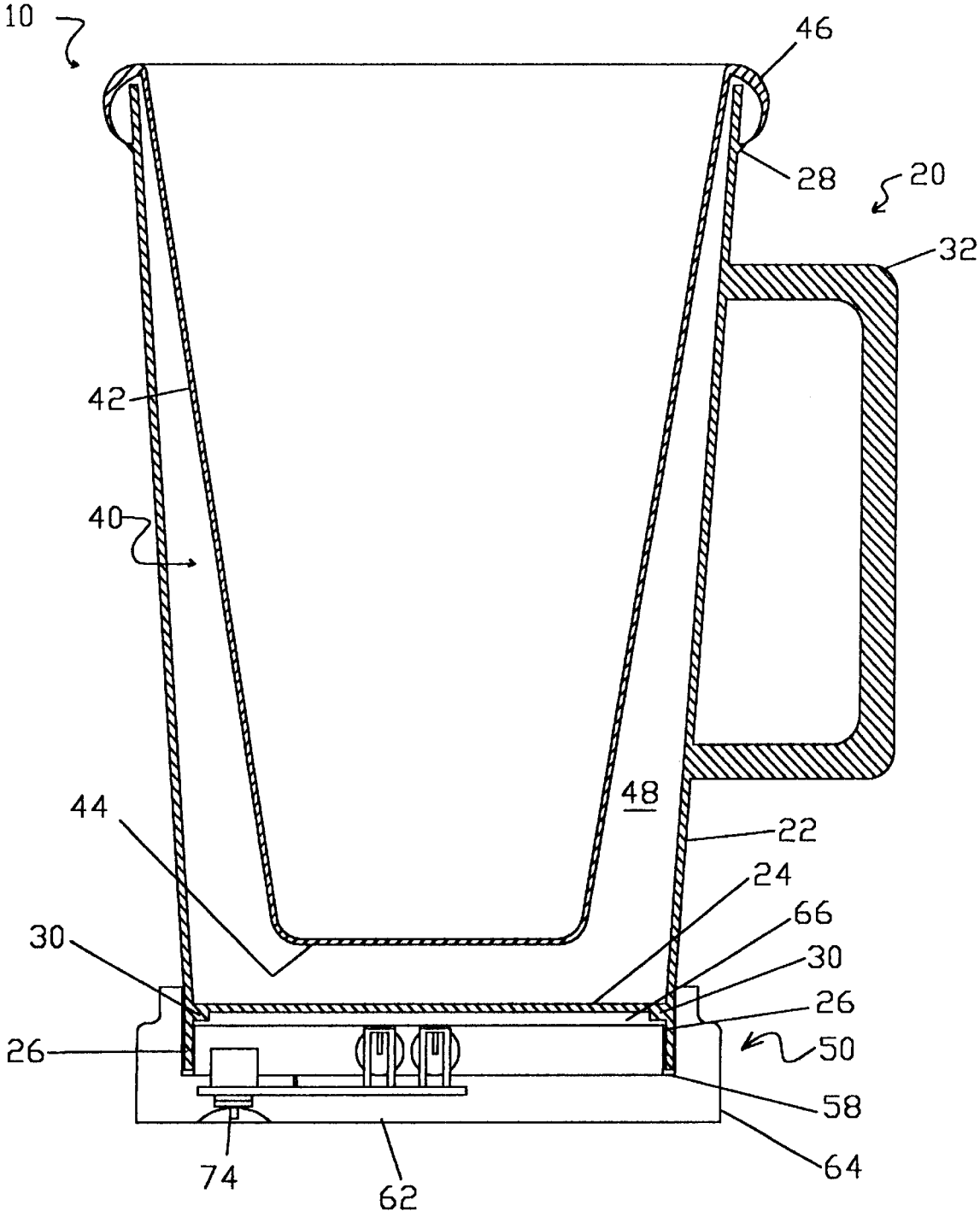
FIG. 3 is a cross-sectional side view of the present invention cut along cutting plane 3—3, as shown on FIG. 1.
Figure 5:
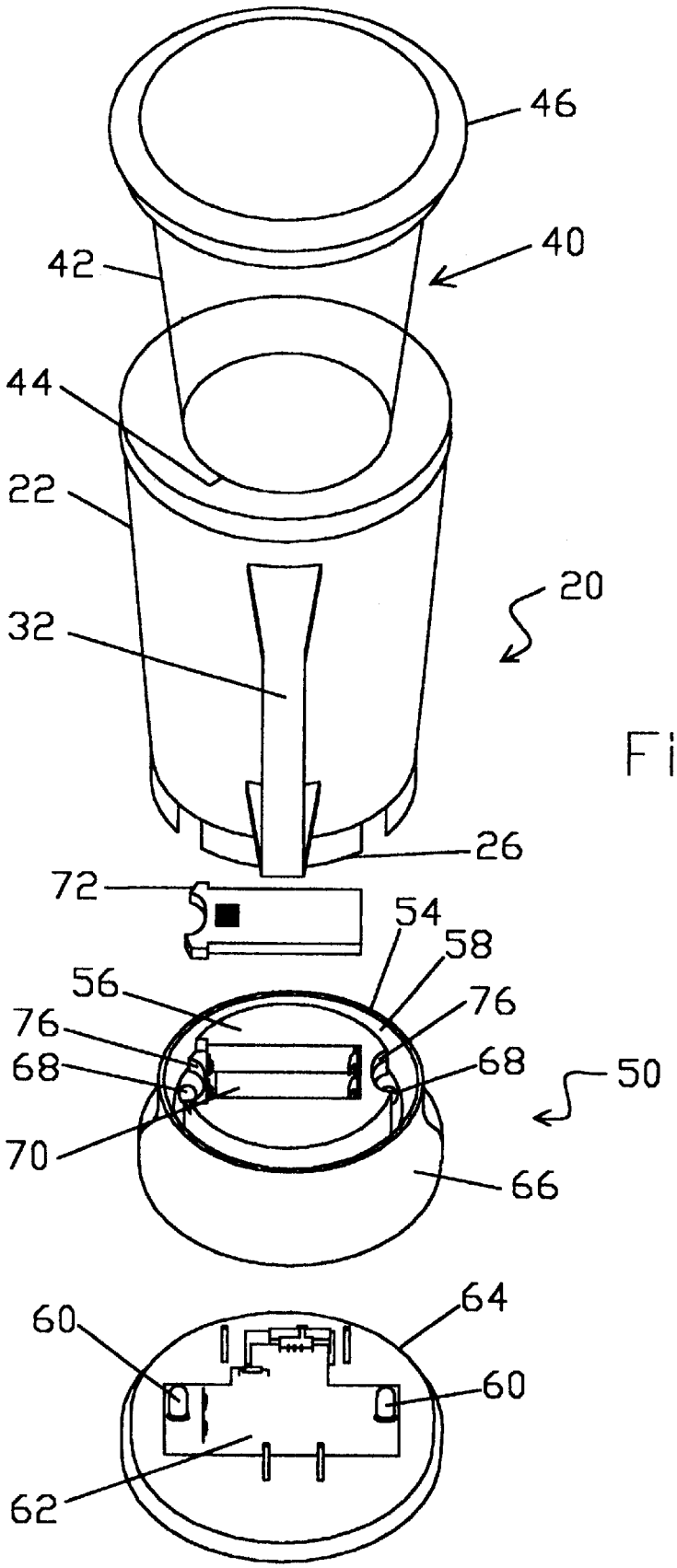
FIG. 5 is an oblique exploded view of the container.

A preferred embodiment of the container with illuminated interior visual display 10 is shown in FIGS. 1–3 and in a simplified exploded view in FIG. 5. The container 10 includes a transparent and circular outer container having a peripheral wall 22 and a transparent bottom 24. Extending from the bottom 24 are feet 26. A shoulder 28 extends about the circumference of the outer container 22. An light altering element 30, in the form of an additional outer container bottom 24 thickness, is generally planar and extends downwardly from the outer container bottom 24, and is adjacent the outer container peripheral wall 22 about the outer container 20 circumference. A handle 32 is provided.

An inner container 40 has a peripheral wall 42, bottom 44, and upper rim 46. When pressed into the outer container 20, the outer container 20 and inner container 40 are fixed together as the inner container upper rim 46 joins the outer container shoulder 28.

When so supported, a peripheral wall cavity 48 is formed between the inner container peripheral wall 42 and the outer container peripheral wall 22. Similarly, a peripheral bottom cavity 50 is formed in embodiments of the present invention wherein the inner container 40 is elevated above the outer container bottom 24. In other embodiments, the inner container 40 extends to the outer container bottom 24, leaving only the peripheral wall cavity 48.

As shown in FIG. 5, a circular, detachable base 50 is provided with an outer wall 54 and an island 56 within the outer wall 54 forming an indexed channel 58 that coincides with the indexed outer container feet 26. The tight fit of the outer container feet 26 within the channel 58 secures the base 50 to the outer container 20 in precisely the right position to orient the light emitting diodes 60 as desired with respect to the inner container 40 and outer container 20. The base 50 is opaque and constructed from plastic although other materials, including wood and various metals, could also be used. In other embodiments, the base 50 is integrated into the outer container 20.

The light emitting diodes 60 are mounted on a switch-operated typical printed circuit board 62 positioned on a base bottom portion 64, from which they extend through a base top portion 66 via holes 68. The base bottom portion 64 and top portion 66 are joined by a typical snap-fit configuration.

A recess 70 in the island 56 is sized to hold typical batteries, the batteries powering the light emitting diodes 60. The batteries 71 are secured in the recess 70 by battery recess cover 72. A switch 74 activates the light emitting diodes 60. The electrical connections accessing the batteries 71 are well known in the industry.

As shown in FIG. 5, a curved recess 76 is provided in the island 56 such that the light emitting diode holes 68 present the light emitting diodes 60 in a position that is adjacent, but out of channel 58, leaving the light emitting diodes 60 adjacent the outer container feet 26 and within the perimeter of the inner surface of the outer container peripheral wall 22.

Figure 4:
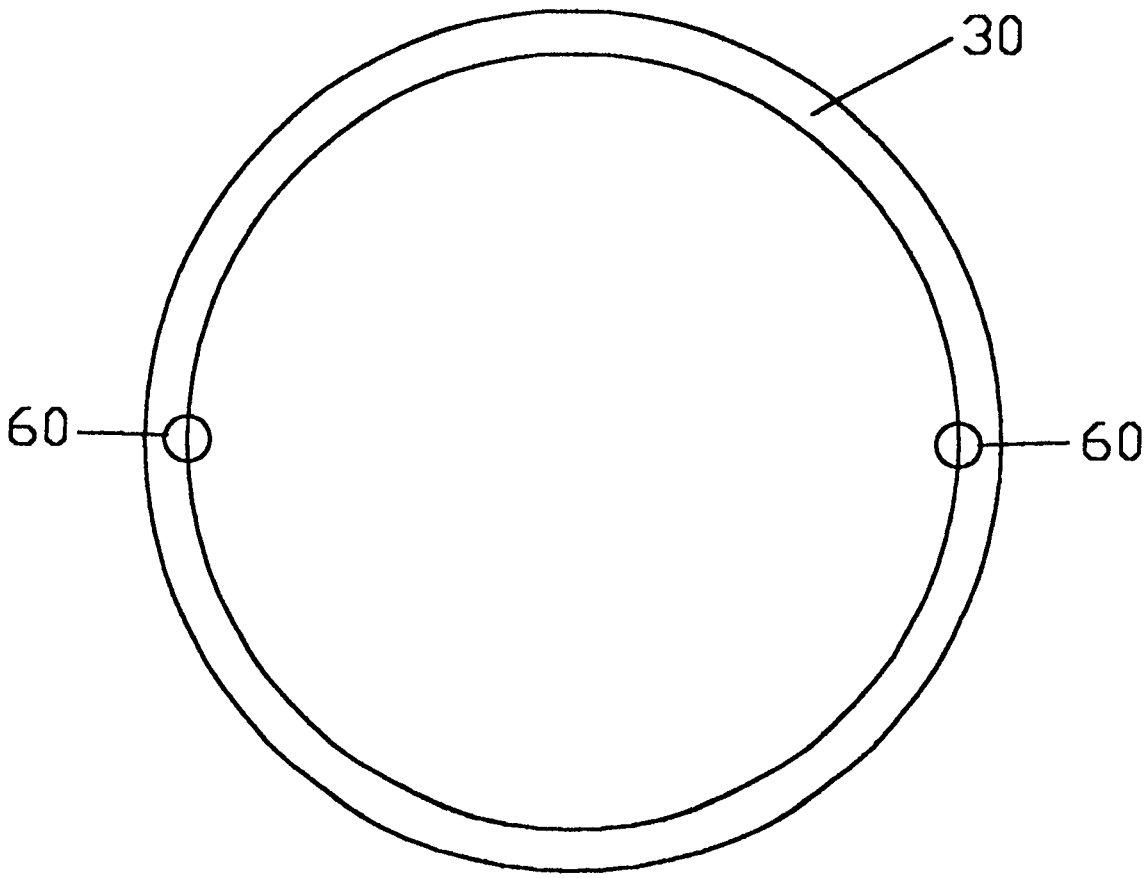
FIG. 4 is a limited top view of the two edges of the light altering element on the outer container and the position of the innermost edge with respect to the light emitting diodes.

As shown in FIG. 2 and FIG. 4, each light emitting diode 60 is positioned such that an imaginary line from the innermost edge of the light altering element 30 will be approximately centered on the underlying light emitting diode 60. This arrangement causes light ascending from the light emitting diode 60 to be directed away from the inner surface of the outer container peripheral wall 22, into targeted portions of the peripheral wall cavity 48, then on to targeted portions of the outer surface of the inner container peripheral wall 42 and inner container bottom 44.

This directional diffusion of the light can be seen through the outer container peripheral wall 22 as the light illuminates substantial targeted portions of the peripheral wall cavity 48, as well as, targeted portions of the inner container bottom 44 edge and inner container peripheral wall 42. Such illumination, while attractive in its own right, readily provides ample and variable illumination of a wide variety of messages, designs, figures, symbols and the like, such as the screen printed "Moonglass" emblem 49 shown in FIG. 1. The screen printing includes screen printing ink with thinner, retarder, and other additives, known in the industry, that cause the printed matter to appear like an illuminated sign when exposed to the light from the light emitting diodes 60.

Figure 6:
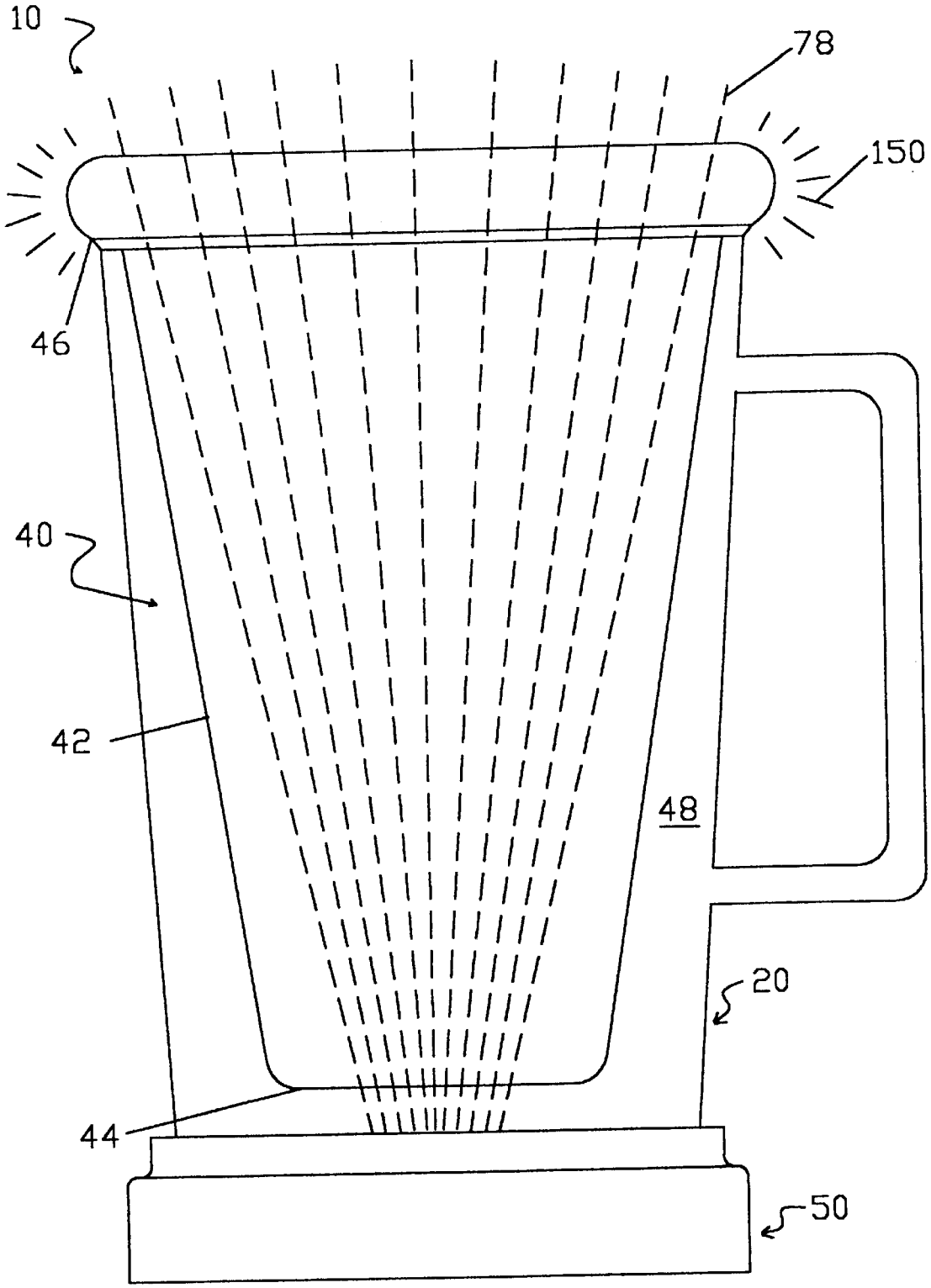
FIG. 6 is a side view of the present invention with an embodiment of the inner container depicted along with an approximation of the light mantle resulting from the use of the particular inner container embodiment shown.

My invention includes several types and shapes of inner containers, as shown in FIGS. 6–15, with a large array of light patterns resulting from the positioning of the light emitting diodes 60 discussed above. For example, the inner container 40 of FIGS. 1–2 is shown in FIG. 6 with the approximate shape of the resulting light mantle 78 shown in broken lines. This inner container 40 is circular with a constant taper to the inner container bottom 44. The joinder of this inner container's peripheral wall 42 to the bottom 44 is curved, although an angular transition is also provided.

Figure 7:
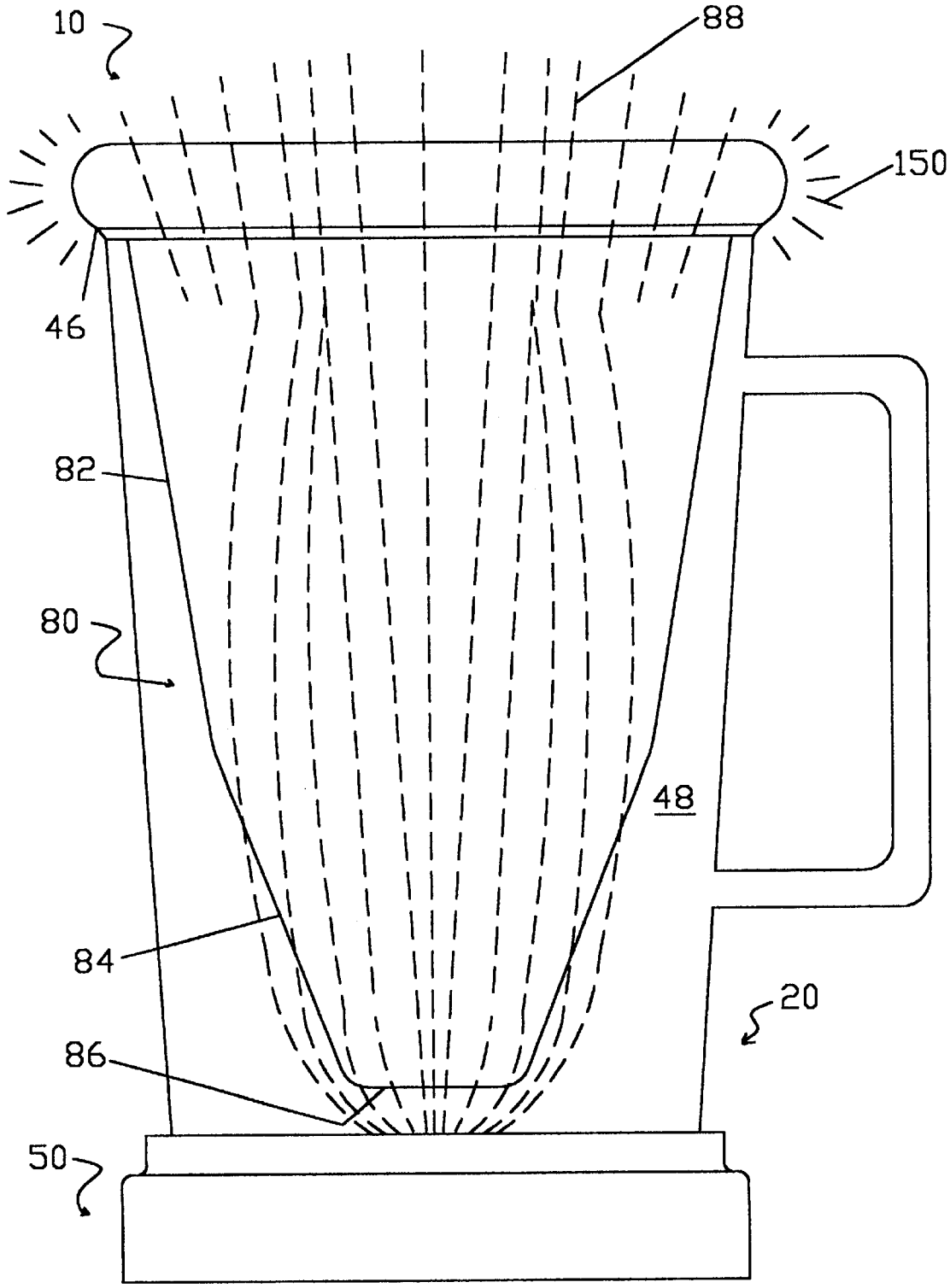
FIG. 7 is a side view of the present invention with an embodiment of the inner container depicted along with an approximation of the light mantle resulting from the use of the particular inner container embodiment shown.

Another inner container 80 is shown in FIG. 7, and is circular, including a peripheral wall first portion 82, second portion 84, and bottom 86. The first peripheral wall portion 82 has a constant taper which joins with the more severely tapered second peripheral wall portion 84. This inner container 80 also has a curved transition from the second peripheral wall portion 84 to the bottom 86, with an angular transition also provided. The resulting light mantle 88 is shown to be strikingly different from that of inner container 20 in FIG. 6.

Figure 8:
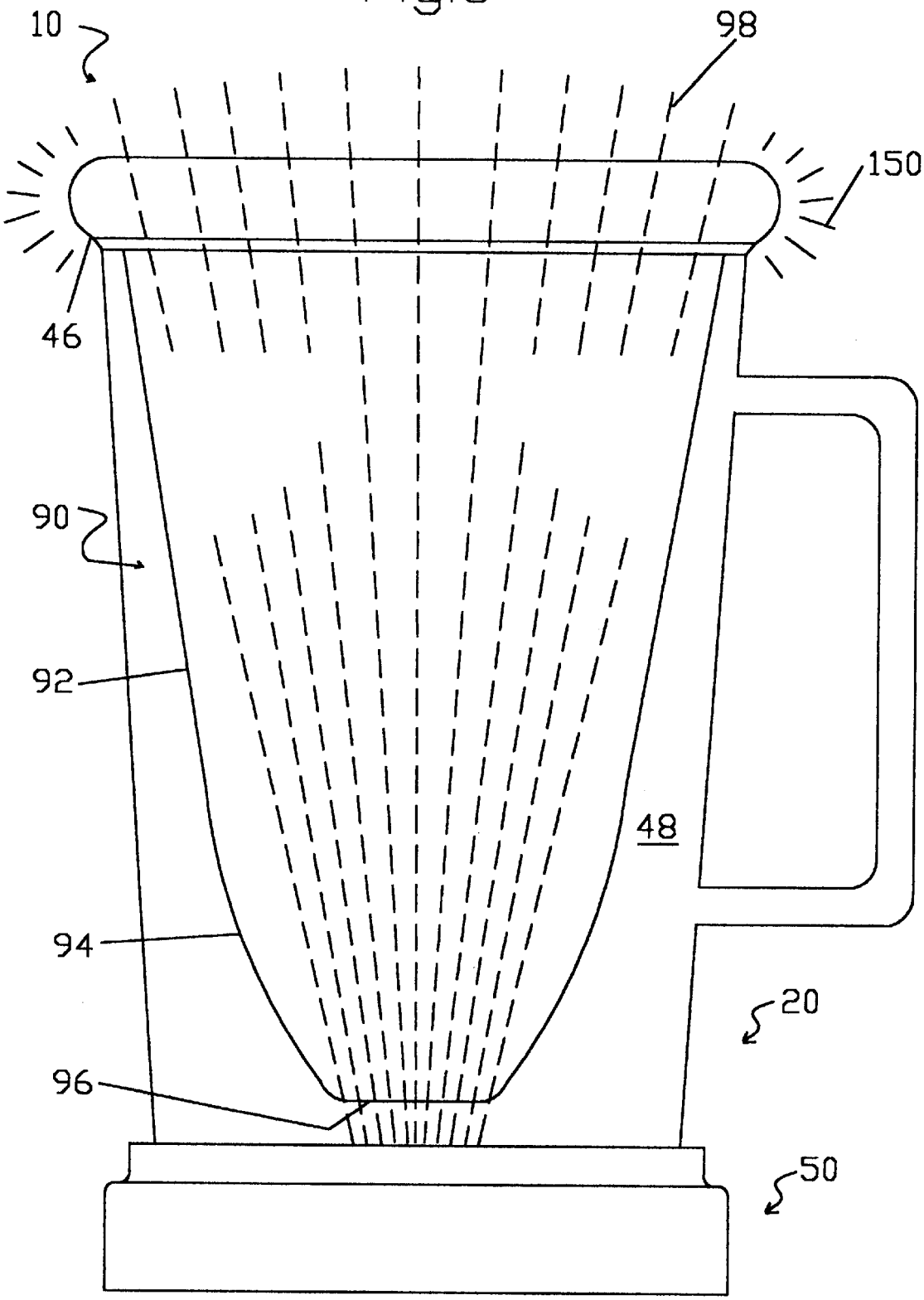
FIG. 8 is a side view of the present invention with an embodiment of the inner container depicted along with an approximation of the light mantle resulting from the use of the particular inner container embodiment shown.

In another circular inner container 90, shown in FIG. 8, a first peripheral wall portion 92 joins a curved second peripheral wall portion 94, which in turn joins the bottom 96. Such joinder with the bottom 94 is curved as shown, with an angular joinder also provided. Yet another light mantle 98 shape results from this embodiment.

Figure 9:
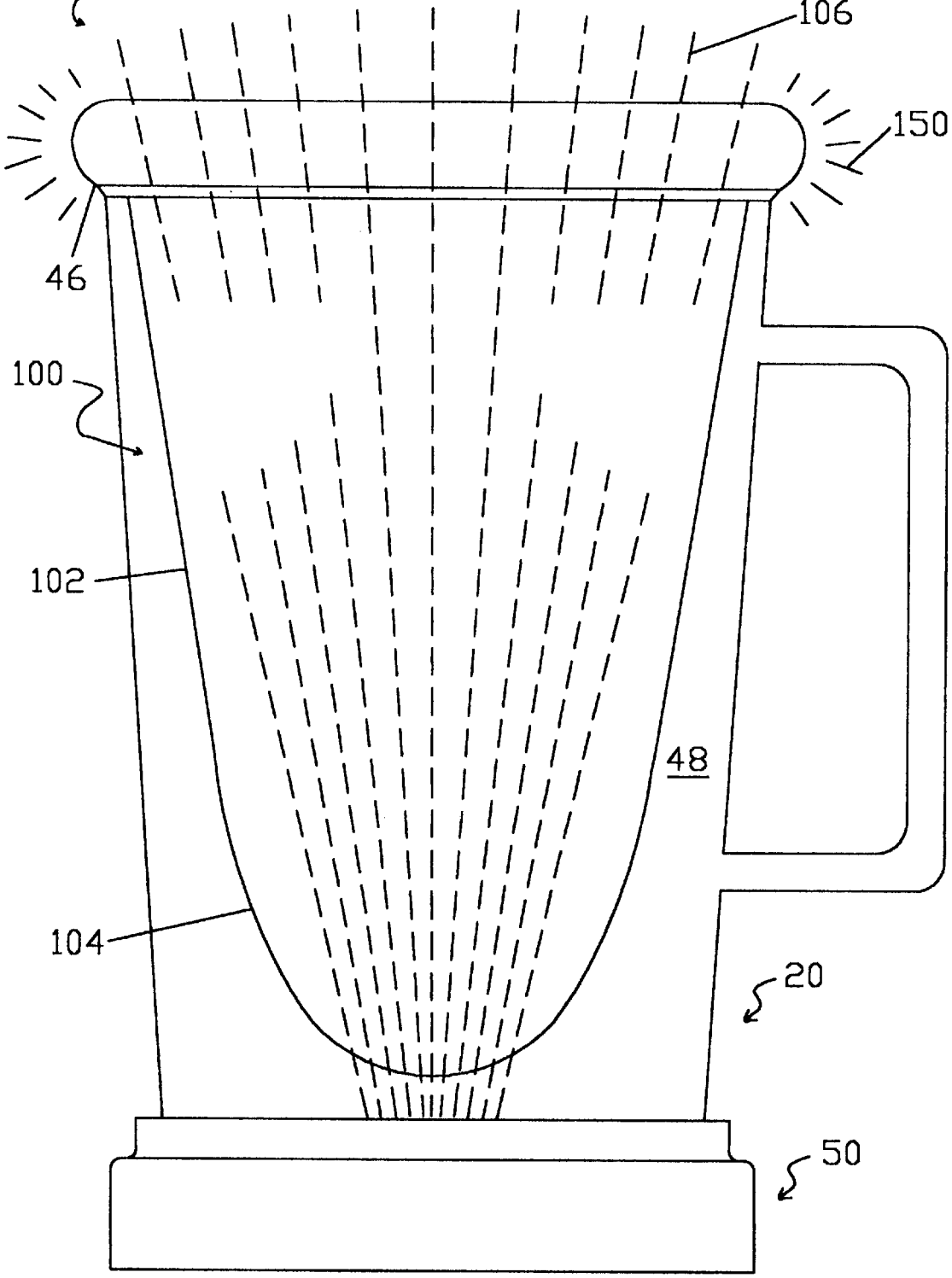
FIG. 9 is a side view of the present invention with an embodiment of the inner container depicted along with an approximation of the light mantle resulting from the use of the particular inner container embodiment shown.

FIG. 9 depicts another inner container 100 that is circular and has a first peripheral wall portion 102 that joins a second peripheral wall portion 104, the second portion being rounded with no flat bottom. The resulting light mantle 106 from this arrangement is similar to the light mantle shown in FIG. 8.

Figure 10:
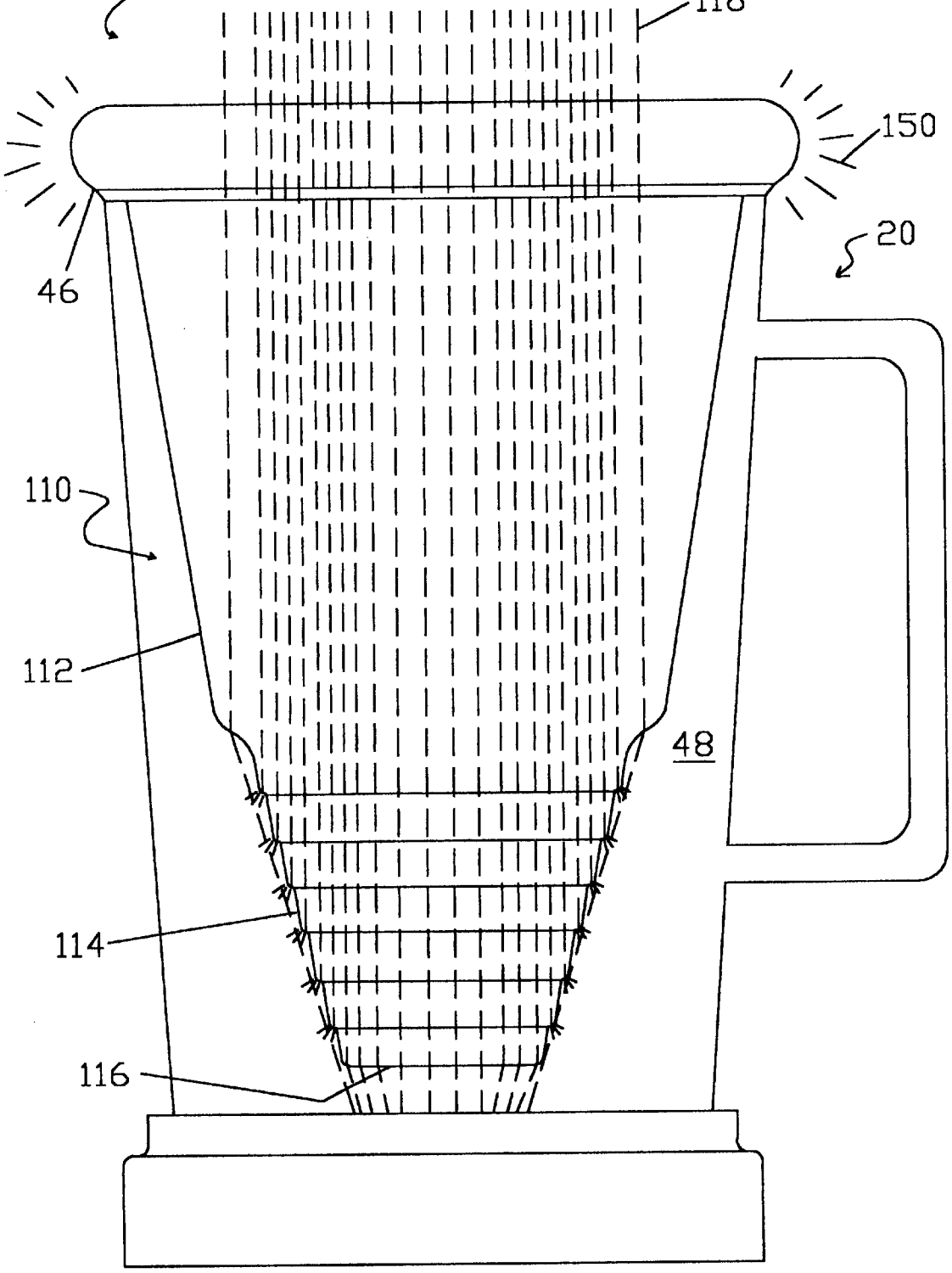
FIG. 10 is a side view of the present invention with an embodiment of the inner container depicted along with an approximation of the light mantle resulting from the use of the particular inner container embodiment shown.

Another inner container 110 is circular with a first peripheral wall portion 112 and a second peripheral wall portion 114, the first portion 112 having a constant taper and the second portion 114 having a stepped reduction in radius to the bottom 116. As shown in FIG. 10, the resulting light mantle 118 is again unique and includes a greater intensity of light glow along the edges of the steps, as shown by the isolated light beam groupings shown in FIG. 10 as emanating from such edges. Such edges are aspects, the term "aspect," as used herein, referring to a side or surface facing a particular direction. In FIG. 10 the aspect is the bend in each step as the radius is reduced to being the next lower step.

Figure 11:
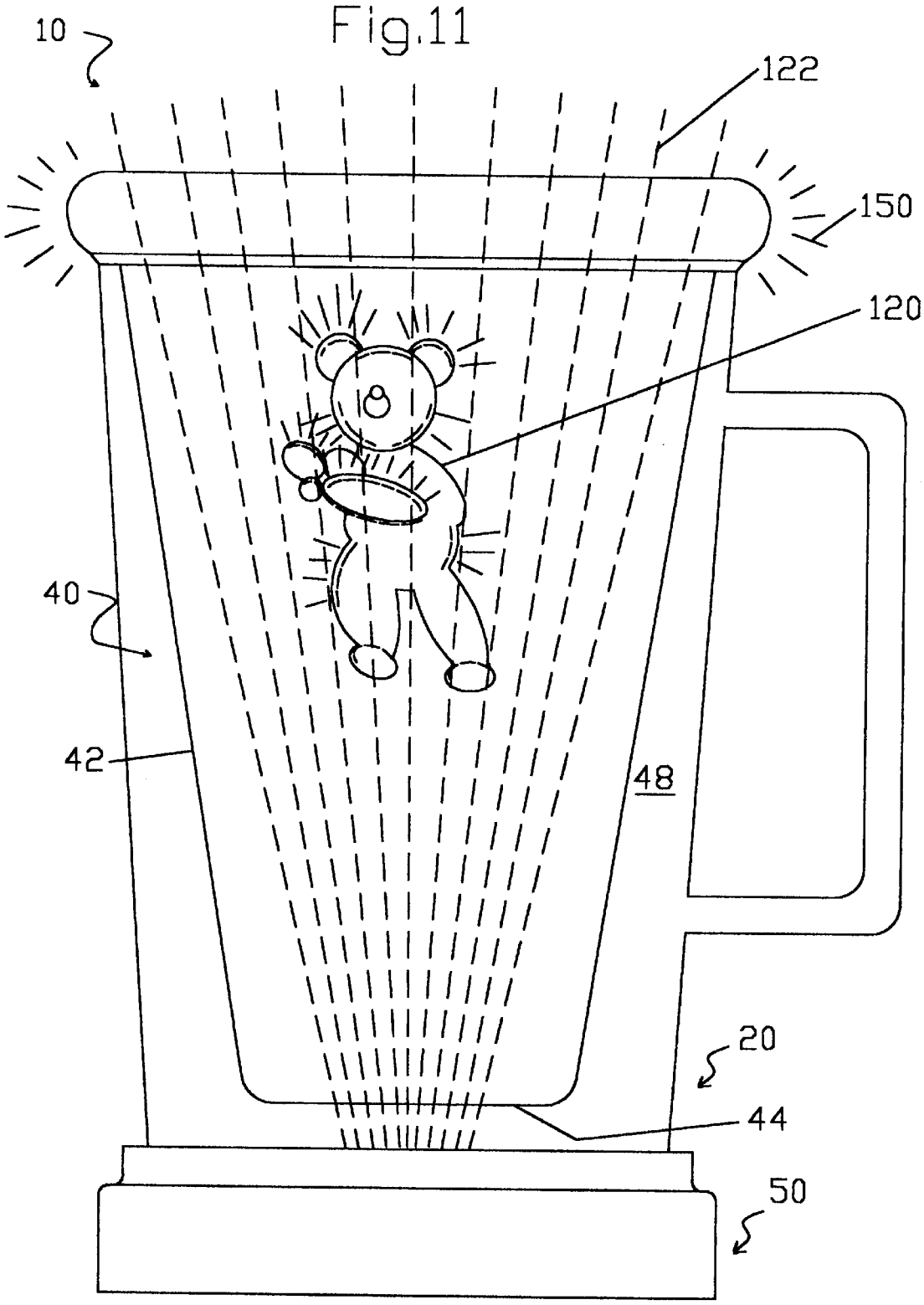
FIG. 11 is a side view of the present invention with an embodiment of the inner container depicted along with an approximation of the light mantle resulting from the use of the particular inner container embodiment shown.

FIG. 11 illustrates the addition of a figure 120 onto the inner container 20 of FIG. 6. The resulting light mantle 122 depicts the enhanced light intensity on certain aspects of the figure 120 in broken lines. Figure 120 is typical of figures, designs, symbols and the like that are attractively presented when protruding.from the inner container peripheral wall 42.

Directing the light from the light emitting diodes 60 to the peripheral wall cavity 48 from a position proximate, but within the perimeter marked in vertical footprint by the inner surface of the outer container peripheral wall 22, enables a unique aspect of my invention. This aspect is the ability to light such figures 120 and other messages on the inner container 40 using light from the peripheral wall cavity 48, as well as, light that has encountered the inner container bottom 44 and/or peripheral wall 42.

The light from the peripheral wall cavity 48 provides direct illumination of the figure 120, while a portion of the light encountering the inner container bottom 44 and/or the peripheral wall 44 enters the same, and travels through the inner container peripheral wall 42 to the figure 120. When the light in the inner container peripheral wall 42 encounters the figure 120, or other nonconformities in the inner container peripheral wall 42, such as etchings, recessed lettering, designs, symbols and the like, the light is redirected from the inner container peripheral wall 42 for viewing through the outer container peripheral wall 22. Both a glow effect and an enhanced intensity result from such nonconformities.

Figure 12:
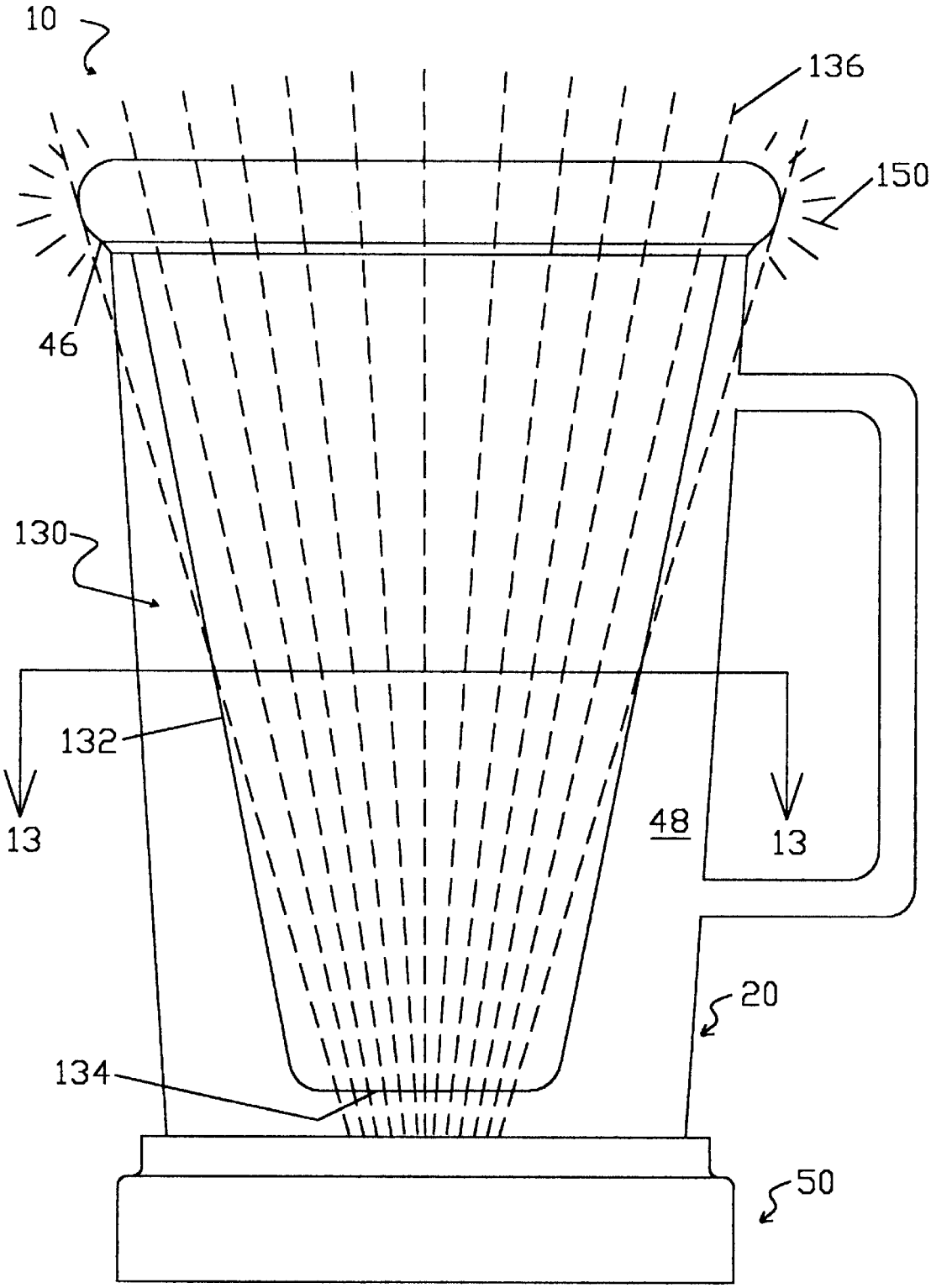
FIG. 12 is a side view of the present invention with an embodiment of the inner container depicted along with an approximation of the light mantle resulting from the use of the particular inner container embodiment shown.
Figure 13:
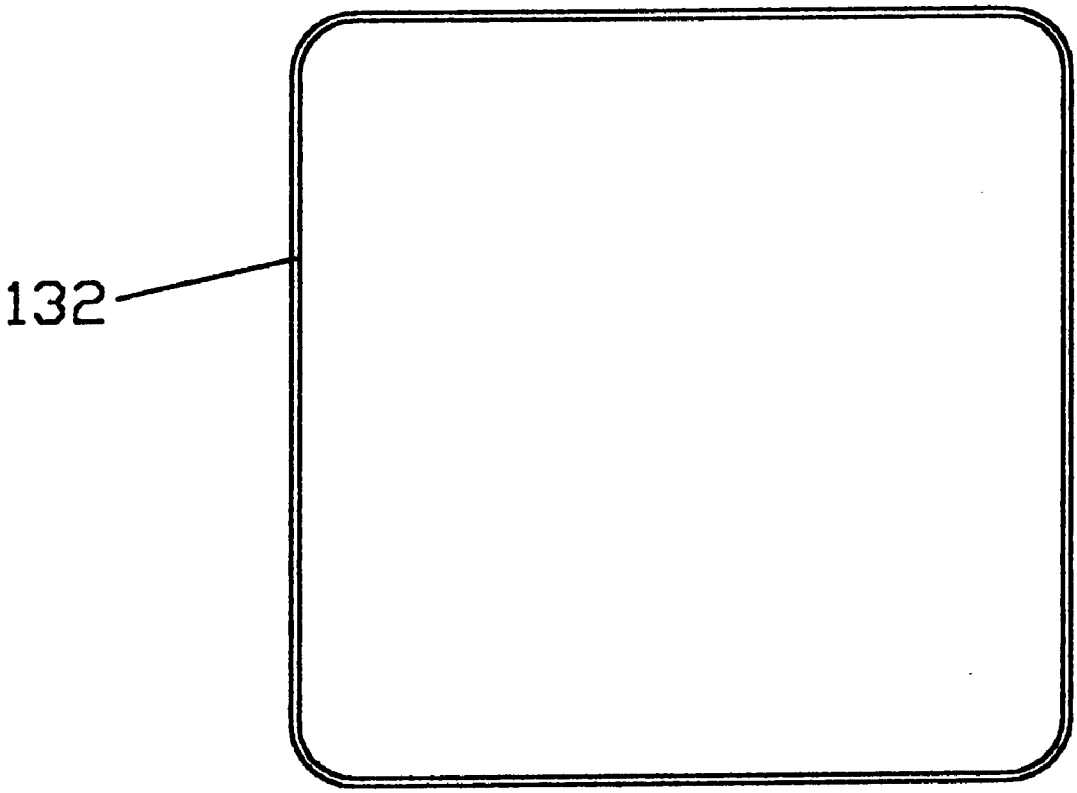
FIG. 13 is a cross-sectional top view cut along cutting plane 13—13, as shown on FIG. 12.

A non-circular inner container 130 is shown in FIG. 12, including a peripheral wall portion 132 and bottom 134. The resulting light mantle 136 is particularly wide. FIG. 13 shows the generally square shape of the inner container 130 in this embodiment, with rounded corners 138 shown, although angular corners are also provided.

Figure 14:
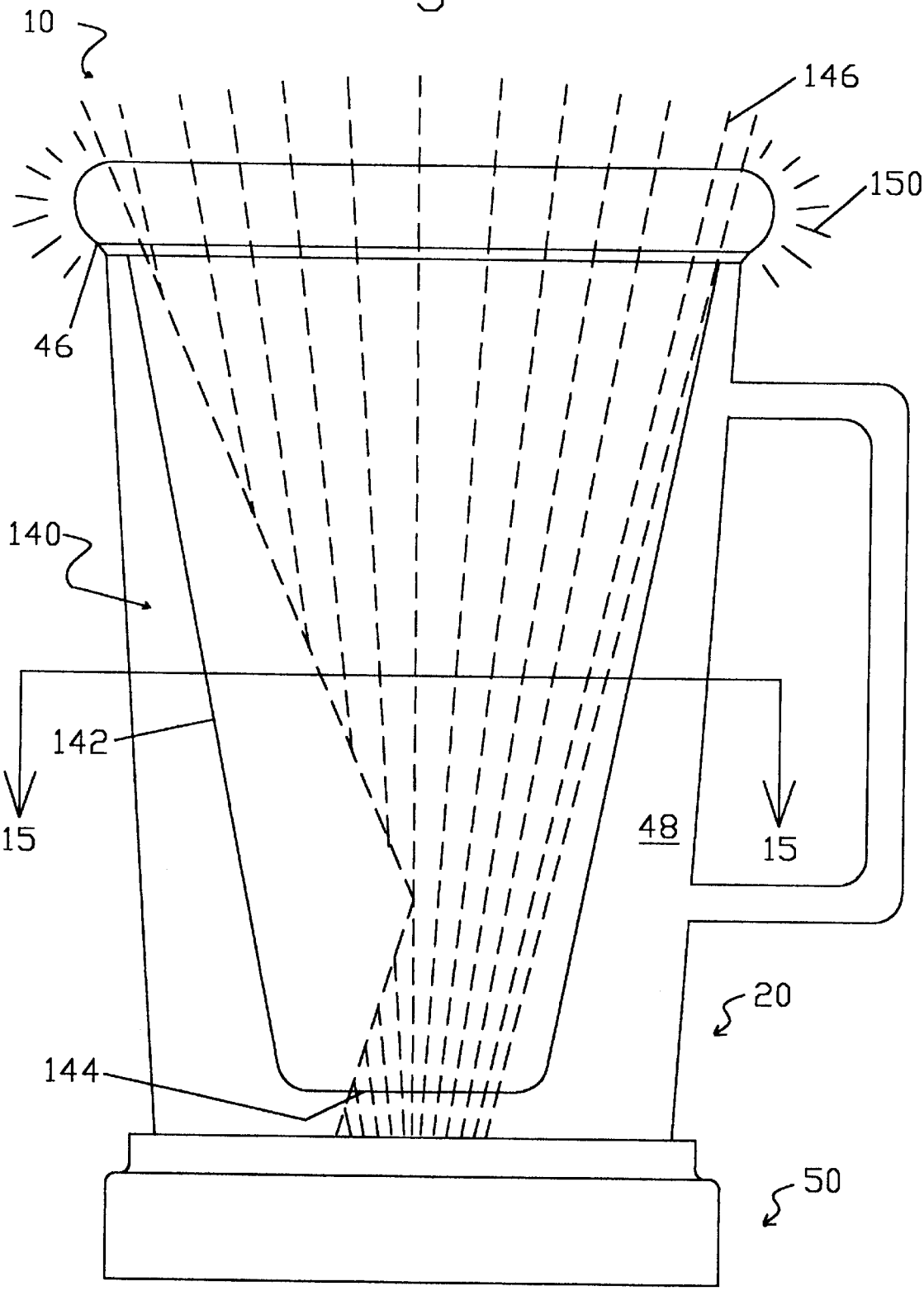
FIG. 14 is a side view of the present invention with an embodiment of the inner container depicted along with an approximation of the light mantle resulting from the use of the particular inner container embodiment shown.
Figure 15:
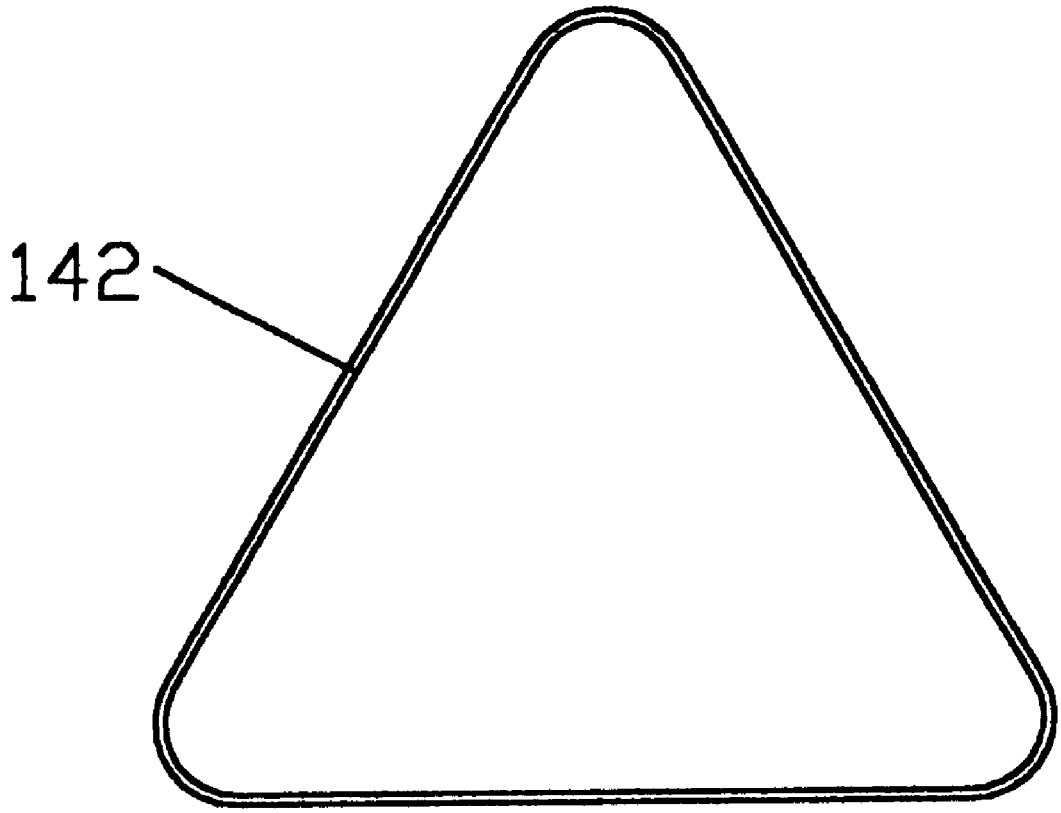
FIG. 15 is a cross-sectional top view cut along cutting plane 15—15, as shown on FIG. 14.

Another non-circular inner container 140 is shown in FIG. 14. It has a peripheral wall portion 142 and bottom 144, with rounded corners 146, as shown in FIG. 15, although square corners are also provided. The resulting light mantle 146 is strikingly angular and asymmetrical.

As shown in FIG. 2, the light within the peripheral wall cavity 48 can also enter the inner container upper rim 46 area causing the upper rim 46 to glow as shown by light rays 150 in FIG. 6 and others.

The distinctive light mantles in FIGS. 6–11 and FIGS. 12 and 14, all resulted from the light altering element 30 shown in FIG. 2 and FIG. 4 and the thicknesses and spacings of the inner container 40 and outer container 20. My invention provides the ability to obtain other aesthetically pleasing light mantles and to target differing areas of the inner container peripheral wall 42, by variations in the width of the peripheral wall cavity 48, the taper angles of either or both of the inner container 40 and outer container 20, the height of the container 10, generally, the type of material used for the outer and inner containers 20,40, and the position, dimensions and shape of the light altering element 30. For example, the light altering element can be proximate the outer container bottom 24 instead of integrated within such bottom 24.

For additional variations on the overall visual appearance through the outer container peripheral wall 22, the outer and inner containers 20,40 can be constructed from other clear or tinted acrylic plastics or glasses.

Similarly, the light emitting diodes 60 can include colored diodes in red, orange, yellow, green, blue, and other colors in addition to white. Such diodes can be clear, discrete, diffused, dome shaped, cylindrical, rectangular, and/or flat-topped, and can include varying emission angles, as suitable for the chosen configuration of the peripheral wall cavity 48 and the light altering element 30. Conventional bulbs can also be used since the island recesses 76 will direct the light upwardly to the peripheral wall cavity 48.

Furthermore, various ink formulations for screen-printed messages and images on the inner container peripheral wall 42 can provide variations in the overall visual appearance through the outer container peripheral wall 22. Variations in the number of light emitting diodes 60, and in the spacing of the same about the base channel 58 perimeter, will also create variations in the overall visual appearance, and my invention provides for any number of such light emitting diodes 60.

The visual appearance can especially be optimized by the selection of the materials and shapes for protruding figures such as the one in FIG. 11, as well as, for other raised or recessed messages and displays.

All such variations and substitutions are in accordance with the present invention, and as determined by the intended end use for the overall device, as will occur to those of skill in the art upon review of the present disclosure.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various advertising, marketing and decorative applications without omitting features that, from the standpoint of prior art, fairly constitute essential characteristics of the generic or specific aspects of this invention.

What is claimed as new and desired to be protected by Letters Patent is set forth in the appended claims:

1. An illuminated container, comprising:

an outer container having a peripheral wall and a bottom, the outer container peripheral wall and bottom being at least partially light-pervious;

an inner container having an outer surface, the inner container positioned at least partially within the outer container to form a peripheral wall cavity between at least a portion of the inner container outer surface and the outer container peripheral wall; and at least one light source positioned beneath the outer container bottom in a substantially vertical alignment with the peripheral wall cavity, such that the light source directs light through the outer container bottom, into the peripheral wall cavity and onto the inner container outer surface, the illuminated portion of the inner container outer surface being at least partially visible through the outer container peripheral wall.

2. The container of claim 1, further comprising a light altering element positioned with respect to the at least one light source such that at least part of the light is directionally altered prior to striking the inner container outer surface.

3. The container of claim 2, wherein the light altering element is positioned above the outer container bottom.

4. The container of claim 2, wherein the light altering element is positioned below the outer container bottom.

5. The container of claim 2, wherein the light altering element is attached to the outer container and is positioned above the outer container bottom.

6. The container of claim 2, wherein the light altering element is attached to the outer container and is positioned below the outer container bottom.

7. The container of claim 1, wherein the outer container bottom further comprises a light altering element such that at least part of the light is directionally altered prior to striking the inner container outer surface.

8. The container of claim 7, wherein the outer container peripheral wall has a curved inside surface and the light altering element is generally planar and curved, the light altering element curve following the outer container peripheral wall curved inner surface.

9. The container of claim 8, wherein the at least one light source has a light emitting portion and the light altering element has an inside edge, the inside edge being positioned such that an imaginary line extending perpendicularly from the inside edge intersects the at least one light source light emitting portion.

10. The container of claim 1, wherein the inner container further comprises a peripheral wall and at least one light altering nonconformity on the peripheral wall.

11. The container of claim 10, wherein the light altering nonconformity alters the direction of light striking the light altering nonconformity from the peripheral wall cavity.

12. The container of claim 10, wherein a portion of the light striking the inner container outer surface enters and is transported by the inner container peripheral wall to the light altering nonconformity, and the light altering nonconformity alters the direction of such light.

13. The container of claim 10, wherein the light altering nonconformity protrudes from the inner container outer surface.

14. The container of claim 10, wherein the light altering nonconformity is recessed in the inner container peripheral wall.

15. The container of claim 10, wherein the light altering nonconformity includes alphanumeric characters and figures.

16. The container of claim 10, wherein the light altering nonconformity includes designs.

17. The container of claim 10, wherein the light altering nonconformity is illuminated by the altered light such that the nonconformity is visible through the outer container peripheral wall.

18. The container of claim 10, wherein the light altering nonconformity causes a portion of the light to be directed toward the outer container peripheral wall.

19. The container of claim 10, wherein the light altering nonconformity further comprises at least one aspect, the light altering nonconformity causing a portion of the light to intensify the illumination of the at least one aspect.

20. The container of claim 10, wherein the light altering nonconformity causes a portion of the light to be diffused.

21. The container of claim 1, wherein the inner container further comprises a peripheral wall and a bottom, the positioned inner container forming a bottom peripheral cavity between the inner container bottom and the outer container bottom.

22. The container of claim 21, wherein the inner container further comprises at least one light altering nonconformity on the inner container peripheral wall.

23. The container of claim 22, wherein a portion of the light striking the inner container outer surface enters the inner container bottom and is transported through the inner container peripheral wall to the light altering nonconformity, and the light altering nonconformity alters the direction of such light.

24. The container of claim 1, wherein the inner container has a generally planar bottom and a peripheral wall, the peripheral wall being circularly shaped and tapered along its length to the bottom.

25. The container of claim 24, wherein the joinder of the inner container peripheral wall to the inner container bottom is angular.

26. The container of claim 24, wherein the joinder of the inner container peripheral wall to the inner container bottom is curved.

27. The container of claim 1, wherein the inner container has a generally planar bottom and a peripheral wall, the peripheral wall being circularly shaped and tapered along a first portion of its length at one angle, and along a second portion of its length at a second, more severe angle, to the bottom.

28. The container of claim 27, wherein the joinder of the inner container peripheral wall to the inner container bottom is angular.

29. The container of claim 27, wherein the joinder of the inner container peripheral wall to the inner container bottom is curved.

30. The container of claim 27, wherein the change in taper is angular.

31. The container of claim 27, wherein the change in taper is curved.

32. The container of claim 1, wherein the inner container has a generally planar bottom and a peripheral wall, the peripheral wall being circularly shaped and tapered along a first portion of its length, and curved along a second portion of its length to the bottom.

33. The container of claim 32, wherein the joinder of the inner container peripheral wall to the inner container bottom is angular.

34. The container of claim 32, wherein the joinder of the inner container peripheral wall to the inner container bottom is curved.

35. The container of claim 1, wherein the inner container has a bottom and a peripheral wall, the peripheral wall being circularly shaped and tapered along a first portion of its length, and curved along a second portion of its length to the bottom.

36. The container of claim 1, wherein the inner container has a generally planar bottom and a peripheral wall, the peripheral wall being circularly shaped and tapered along a first portion of its length, and radially stepped along a second portion of its length to the bottom.

37. The container of claim 1, wherein the inner container has a generally planar bottom and a peripheral wall, the peripheral wall being square shaped and tapered along its length to the bottom.

38. The container of claim 37, wherein the square shape includes rounded corner shapes.

39. The container of claim 1, wherein the inner container has a generally planar bottom and a peripheral wall, the peripheral wall being triangle shaped and tapered along its length to the bottom.

40. The container of claim 39, wherein the triangle shape includes rounded corner shapes.

41. The container of claim 1, wherein the outer container has a top edge and the inner container has a top edge, the top edge extending over the outer container top edge, the top edge being at least partially illuminated by the light in the peripheral wall cavity, such illumination causing the top edge to glow.

42. The container of claim 1, wherein the outer container has a top edge and the inner container has a top edge, the outer container top edge supporting and securing the inner container top edge.

43. The container of claim 1, wherein the at least one light source is a light emitting diode.

44. The container of claim 43, wherein the at least one light emitting diode is clear.

45. The container of claim 43, wherein the at least one light emitting diode is diffused.

46. The container of claim 43, wherein the at least one light emitting diode is dome shaped.

47. The container of claim 43, wherein the at least one light emitting diode is cylindrical.

48. The container of claim 43, wherein the at least one light emitting diode is rectangular.

49. The container of claim 43, wherein the at least one light emitting diode is flat-topped.

50. The container of claim 43, wherein the at least one light emitting diode emits white light.

51. The container of claim 43, wherein the at least one light emitting diode emits colored light.

52. The container of claim 1, wherein the outer container further comprises a base, the at least one light source being positioned in the base.

53. The container of claim 52, wherein the base is detachable from the outer container.

54. The container of claim 53, wherein the base is configured to receive a battery for powering the at least one light source.

55. The container of claim 53, wherein the base further comprises means for receiving and securing a battery for powering the at least one light source.

56. The container of claim 1, wherein the number of light sources is two.

57. The container of claim 56, wherein the light sources are positioned opposite from each other with respect to the outer container peripheral wall.

58. The container of claim 1, wherein the number of light sources is three.

59. The container of claim 58, wherein the light sources are positioned equidistantly.

60. The container of claim 1, wherein the number of light sources is four.

61. The container of claim 60, wherein the light sources are positioned equidistantly.

62. The container of claim 1, wherein the number of light sources is five or more.

63. The container of claim 62, wherein the light sources are positioned equidistantly.

64. The container of claim 1, wherein the at least one light source is battery powered.

65. The container of claim 1, further comprising means for powering the at least one light source by battery power.

66. An illuminated container, comprising:

an outer container having a peripheral wall and a bottom, the outer container peripheral wall and bottom being at least partially light-pervious;

an inner container having an outer surface, the inner container positioned at least partially within the outer container to form a peripheral wall cavity between at least a portion of the inner container outer surface and the outer container peripheral wall; and means for directing light through the outer container bottom, into the peripheral wall cavity and onto the inner container outer surface, the illuminated portion of the inner container outer surface being at least partially visible through the outer container peripheral wall, said means comprising at least one light source positioned beneath the outer container bottom in a substantially vertical alignment with the peripheral wall cavity.

67. The container of claim 66, further comprising means for directionally altering the light prior to the light striking the inner container outer surface.

68. The container of claim 66, wherein the outer container bottom further comprises means for directionally altering the light prior to the light striking the inner container outer surface.

69. The container of claim 66, wherein the inner container further comprises a peripheral wall and means for altering the light, the means being positioned on the inner container peripheral wall.

70. The container of claim 69, wherein the means for altering the light alters the direction of light striking the light altering means from the peripheral wall cavity.

71. The container of claim 69, wherein a portion of the light striking the inner container outer surface enters and is transported by the inner container peripheral wall to the means for altering the light, and the means for altering the light alters the direction of such light.

72. The container of claim 69, wherein the means for altering the light protrudes from the inner container outer surface.

73. The container of claim 69, wherein the means for altering the light is recessed in the inner container peripheral wall.

74. The container of claim 69, wherein the means for altering the light includes alphanumeric characters figures.

75. The container of claim 69, wherein the means for altering the light includes designs.

76. The container of claim 69, wherein the means for altering the light is illuminated by the altered light such that the means for altering the light is visible through the outer container peripheral wall.

77. The container of claim 69, wherein the means for altering the light causes a portion of the light to be directed toward the outer container peripheral wall.

78. The container of claim 69, wherein the means for altering the light further comprises at least one aspect, the means for altering the light causing a portion of the light to intensify the illumination of the at least one aspect.

79. The container of claim 69, wherein the means for altering the light causes a portion of the light to be diffused.

80. The container of claim 66, wherein the inner container further comprises a peripheral wall and a bottom, the positioned inner container forming a bottom peripheral cavity between the inner container bottom and the outer container bottom, the inner container further comprising means for altering the light, the means for altering the light being on the inner container peripheral wall.

81. The container of claim 80, wherein a portion of the light striking the inner container outer surface enters the inner container bottom and is transported through the inner container peripheral wall to the means for altering the light, the means for altering the light altering the direction of such light.

82. The container of claim 66, wherein the inner container has a top edge and means for illuminating the inner container top edge by light from the peripheral wall cavity, such illumination causing the top edge to glow.

83. An illuminated container, comprising:

an outer container having a peripheral wall and a bottom, the outer container peripheral wall and bottom being at least partially light-pervious;

an inner container having a peripheral wall, the inner container positioned at least partially within the outer container to form a peripheral wall cavity between at least a portion of the inner container peripheral wall and the outer container peripheral wall; and means for directing light through the outer container bottom, into the peripheral wall cavity and onto a targeted portion of the inner container peripheral wall, the illuminated target portion of the inner container peripheral wall being at least partially visible through the outer container peripheral wall, said means comprising at least one light source positioned beneath the outer container bottom in a substantially vertical alignment with the peripheral wall cavity.

84. The container of claim 1, further comprising a light altering element positioned with respect to the at least one light source such that at least part of the light is directionally altered, by diffusion, prior to striking the inner container outer surface.

* * * * *